United States Patent [19]

Lupoli et al.

[11] Patent Number: 4,598,686

[45] Date of Patent: Jul. 8, 1986

[54] FUEL VAPOR RECOVERY SYSTEM FOR AUTOMOTIVE VEHICLES

[75] Inventors: Peter J. Lupoli, Hamden; Donald J. Mattis, Norwalk; Robert S. Miller, Stratford, all of Conn.

[73] Assignee: Casco Products Inc., Bridgeport, Conn.

[21] Appl. No.: 717,515

[22] Filed: Mar. 28, 1985

[51] Int. Cl.[4] ..... F02M 33/02; F02M 31/12

[52] U.S. Cl. ..... 123/519; 123/549; 55/208; 55/267

[58] Field of Search ..... 123/518-521, 123/549; 219/504, 505, 375, 376, 381, 382, 205, 206, 207, 541; 55/208, 267

[56] References Cited

U.S. PATENT DOCUMENTS

| | | | |
|---|---|---|---|
| 3,191,587 | 6/1965 | Hall | 123/519 |
| 3,221,724 | 12/1965 | Wentworth | 123/519 |
| 3,675,634 | 7/1972 | Tatsutomi et al. | 123/519 |
| 3,757,753 | 9/1973 | Hunt | 123/519 |
| 3,927,300 | 12/1975 | Wada et al. | 219/381 |
| 4,108,125 | 8/1978 | Marcoux et al. | 219/206 |
| 4,279,234 | 7/1981 | Marcoux et al. | 123/549 |
| 4,384,563 | 5/1983 | Siefer et al. | 123/549 |
| 4,387,690 | 6/1983 | Chiavaroli | 123/549 |
| 4,448,173 | 5/1984 | Abe et al. | 123/549 |
| 4,450,823 | 5/1984 | Abe et al. | 123/549 |
| 4,477,715 | 10/1984 | Bell et al. | 123/549 |

FOREIGN PATENT DOCUMENTS

| | | | |
|---|---|---|---|
| 648536 | 12/1928 | France | 123/549 |
| 544 | 1/1981 | Japan | 123/519 |
| 32961 | 2/1983 | Japan | 123/549 |

*Primary Examiner*—Magdalen Y. C. Greenlief

*Attorney, Agent, or Firm*—Cynthia Berlow; Mitchell D. Bittman

[57] ABSTRACT

A device for the recovery of fuel vapors originating in the fuel system of a vehicle, particularly at the gas tank thereof or in the carburetor float bowl. In one arrangement, a fuel vapor line connects the fuel tank to an input port of a fuel vapor storage and recovery canister containing activated carbon or charcoal, with another port thereof, referred to as a "purge" port, being connected with either the engine intake manifold or else a vacuum port of the carburetor. Carried by the canister is a self-regulating electric heater assemblage adapted to heat air flowing into the canister through a large air port, thereby to also heat the charcoal. When the vehicle is idle, fumes from the gasoline tank can enter the input port of the canister to be adsorbed and stored by the charcoal. When the vehicle is operated, vacuum from the intake manifold draws air into the canister, causing the heated charcoal to release its stored fuel which is then burned in the engine. The heating action hastens the release of the stored fuel from the charcoal. Otherwise at low temperatures this release would occur very slowly. The end result is less pollution emitted into the atmosphere from the vehicle's fuel system.

38 Claims, 27 Drawing Figures

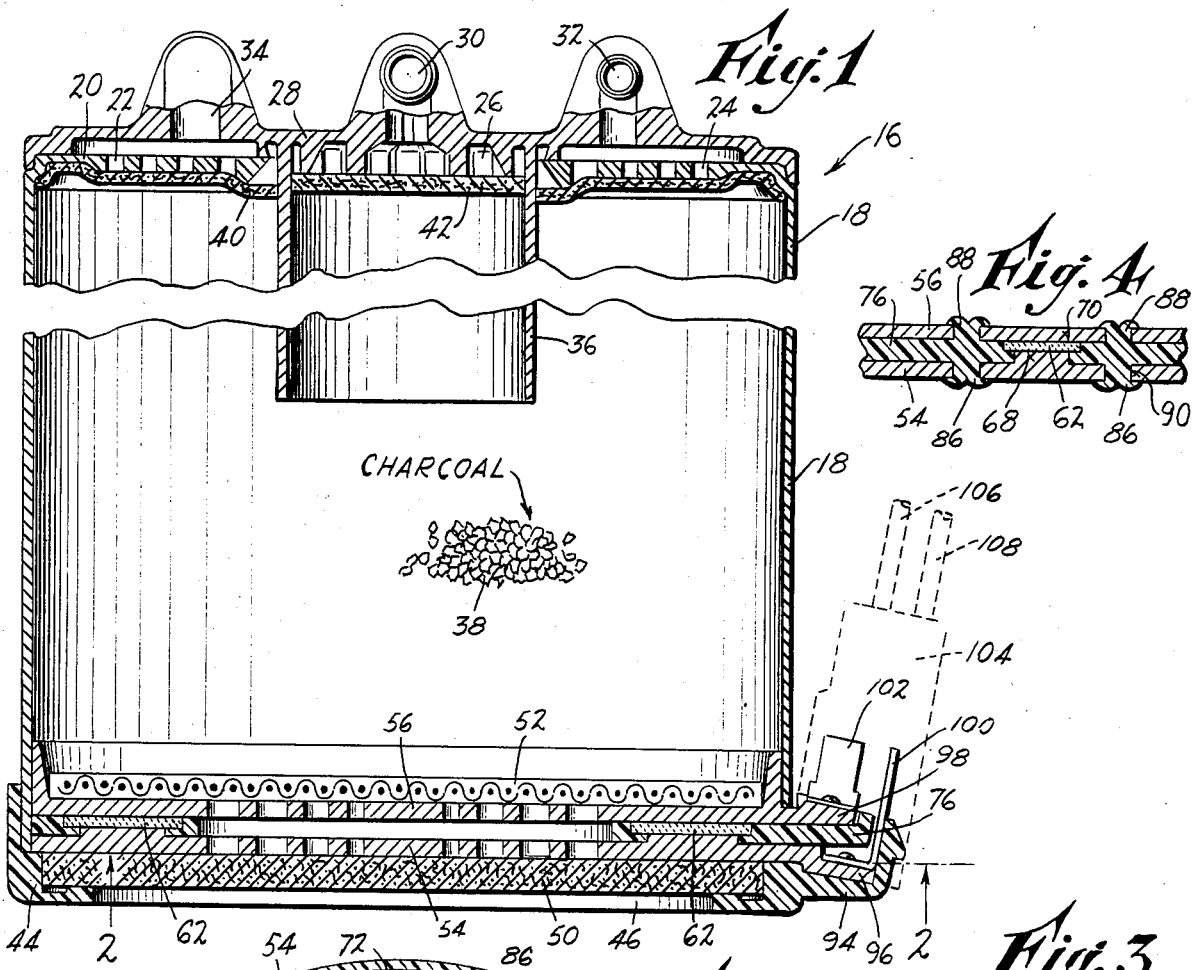
Fig. 1
CHARCOAL
Fig. 4
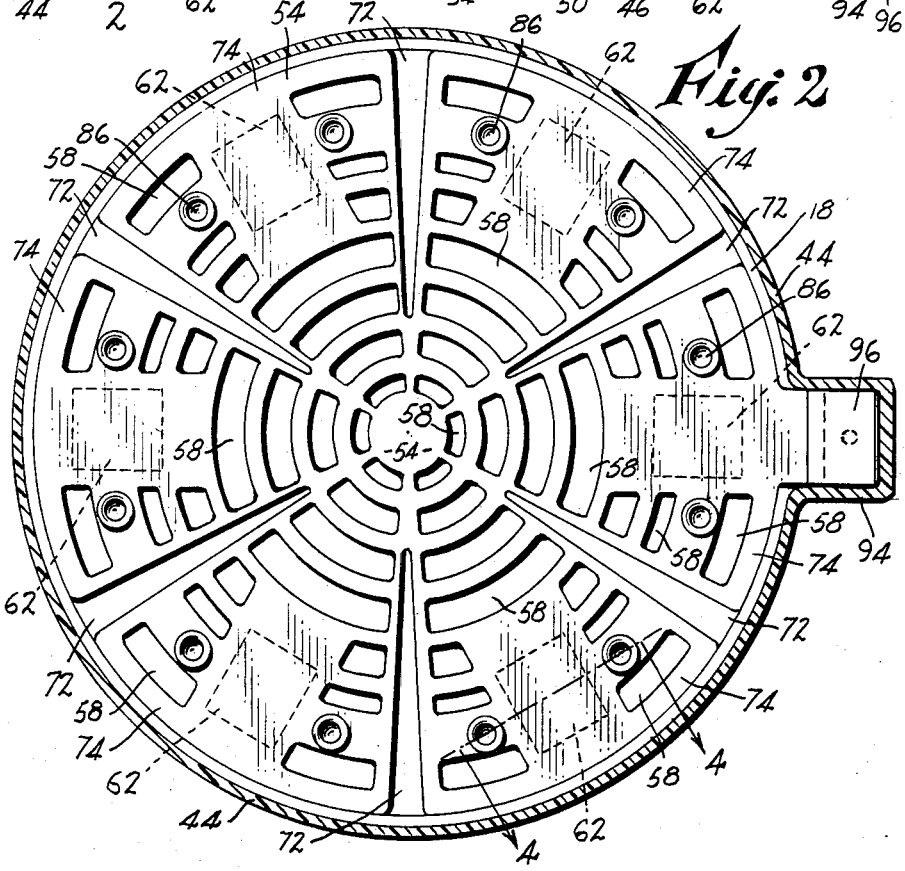
Fig. 2
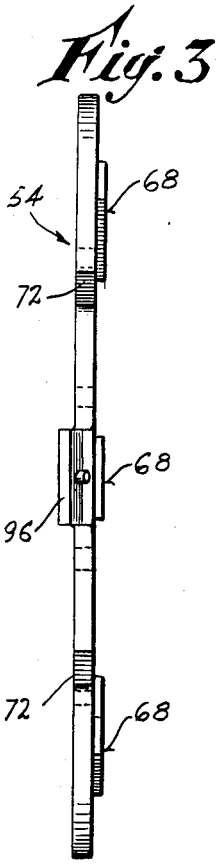
Fig. 3

FUEL VAPOR RECOVERY SYSTEM FOR AUTOMOTIVE VEHICLES

BACKGROUND OF THE INVENTION

This invention relates generally to pollution control systems for automotive vehicles, and more particularly to devices especially adapted to minimize the inadvertent release of fuel vapors from the vehicle engine and fuel system directly into the atmosphere.

Within the past several years a number of attempts have been made to limit the evaporation of gasoline from automotive fuel systems, especially the evaporation which occurs while the vehicles are idle. Special fuel tank caps have been employed in order to reduce or eliminate fumes that would otherwise escape. In addition, recently there has been developed what is generally known as an evaporative emission control system that involves the use of a charcoal-filled canister which is connected, through a vapor line, to the fuel tank such that gasoline vapors from the tank are channelled into the canister and absorbed and partially condensed in the charcoal. The vapor line in this system is connected to an inlet port located at the top of the canister. A second port on the canister is also provided, known as a "purge" port, from which a line extends to the intake manifold or carburetor of the vehicle's engine. When the vehicle is started, condensed fuel and vapor that is stored in the charcoal is released and sucked into the engine to be burned.

The vapor storage and recovery canisters that have previously been employed generally were either of the closed or else the open bottom types. In the open bottom canister, there is a series of relatively large air-intake passages that can admit fresh air from the engine compartment during operation of the engine. This fresh air flow picks up most of the stored fuel from the charcoal and carries it to either the carburetor or else to the intake manifold. Additional fumes which enter the canister during engine operation are purged continuously, leaving the charcoal in a relatively "dry" condition, ready to adsorb fuel after the engine is shut down. Usually there is some type of filter material, such as fiberglass wadding, at the fresh air intake area so as to eliminate any tendency for dirt or dust to be drawn into the canister.

Some canisters have been designed to draw vapors from both the fuel tank and the carburetor float bowl during engine shutdown, and to purge such fuel vapors or their condensate during vehicle operation. Other arrangements, such as that described above, involve recovery of fumes from only the vehicle's fuel tank.

Where it is desired to draw vapors from both the fuel tank and the carburetor float bowl, there are usually required control valves in order to enable the float bowl to vent into the canister when the engine is not running, while still not interfering with the normal operation thereof. In addition, fuel tank pressure valves have been incorporated in certain vehicles, these functioning to restrict venting of the tank during idle periods, and to increase the capability of venting into the canister during engine operation. Various other arrangements have also been proposed and produced.

The major problem with evaporative emission control systems of the type employing activated carbon or activated charcoal as adsorptive materials housed in a vapor canister, is that under conditions of low ambient temperature the fuel that has been adsorbed exhibits a reluctance to be evaporated and purged from the canister. It has been determined that with adsorptive substances currently being employed, satisfactory release of the stored fuel will occur at room temperatures and above; however, when the temperatures fall much below these values, the efficiency of the system suffers significantly. The ability of the carbon to release the fuel is poor until the canister heats up.

Such units are therefore generally located in the engine compartment of the vehicle, and with the exception of extremely cold weather, eventually the desired canister temperatures are reached. However, until this occurs the fuel occupying the canister tends to remain there, as opposed to being promptly drawn into the intake manifold so as to be burned off.

SUMMARY OF THE INVENTION

The above disadvantages and drawbacks of prior evaporative emission control systems of the charcoal-canister type are largely obviated by the present invention, which has for one object the provision of a novel and improved charcoal-type pollution control system which is especially simple in its construction and reliable in operation, and which provides a significant reduction in the undesirable release of fuel vapors into the atmosphere from the engine fuel system over a wide range of ambient temperatures.

A related object of the invention is to provide an improved pollution control system as above characterized, wherein there is realized a significant improvement in the recovery of fuel vapors and condensate that have accumulated while the vehicle is idle, and wherein such recovery is significantly expedited as compared to prior evaporative control systems currently in operation.

Yet another object of the invention is to provide an improved pollution control system of the kind indicated wherein the recovery of fuel vapors and condensate that have accumulated during those periods when the vehicle is idle, promptly begins substantially at the time that the vehicle engine is started, such stored fuel products being quickly and effectively drawn into the engine cylinders to be immediately burned when the engine starts.

Yet another object of the invention is to provide an improved pollution control as above set forth, which is especially safe in operation and not likely to malfunction or cause fires.

A still further object of the invention is to provide an improved pollution control system as outlined above, wherein the parts are simple in structure, being essentially in the form of molded plastic components and simple metal castings or stampings, and wherein the system is adaptable for use with a variety of vehicle types with little or no major modifications being required.

The above objects are accomplished by a pollution control system for automotive vehicles, comprising a fuel system that has a fuel intake device for supplying a combustible vapor mixture to the engine cylinders, a canister connected with the fuel system of the engine and adapted to receive fuel vapors therefrom, a quantity of adsorptive material disposed in the canister and capable of adsorbing vapors introduced therein and for holding them and/or converting them into condensate, and a safe means carried by the canister for imparting heat to the adsorptive material so as to enhance the release of the vapors and condensate at such time as the engine is running and the fuel intake device is providing a vacuum draw from the canister. The latter preferably has a grid that is in heat-exchanging relation with the heating means, to improve the transfer of heat to the adsorptive material. The arrangement is such that when the vehicle is idle, vapors from either the fuel tank or the carburetor float bowl are collected by the canister, adsorbed by the material therein and stored in a vapor and/or condensed state. When the engine is started the stored fuel is quickly drawn off to the fuel intake device, which could be the intake manifold of the engine, to be burned along with the fuel being supplied by the fuel pump. As a result, the release of fuel vapor and its toxic components into the atmosphere is greatly reduced, resulting in significantly improved air quality, all without the need for sealed fuel chambers, or automatic control or sensor circuits to isolate or channel fuel flow through the system.

Other features and advantages will hereinafter appear.

In the drawings, illustrating several embodiments of the invention:

FIG. 1 is an axial sectional view of a charcoal-containing canister constituting a fuel vapor trap and delivery device employed with the evaporative emission control system of the present invention.

FIG. 2 is a horizontal section taken on the line 2—2 of FIG. 1, looking upward.

FIG. 3 is an edge view of one of two heat-conductive metal elements constituting a heated grid employed in the canister of FIG. 1.

FIG. 4 is a fragmentary section taken on the line 4—4 of FIG. 2.

Figure 17:
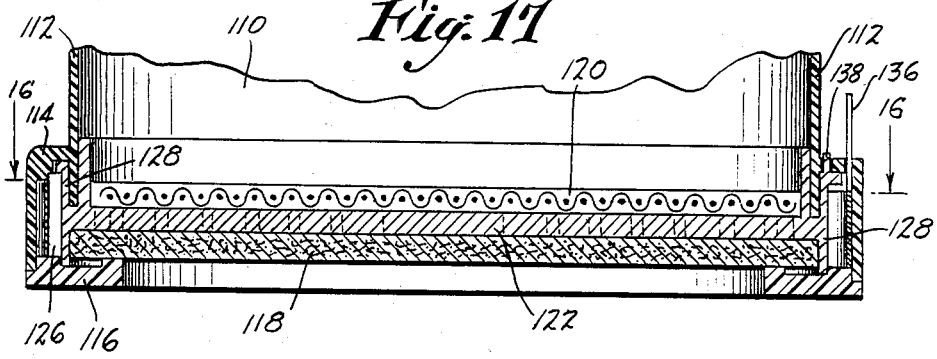
Figure 16:
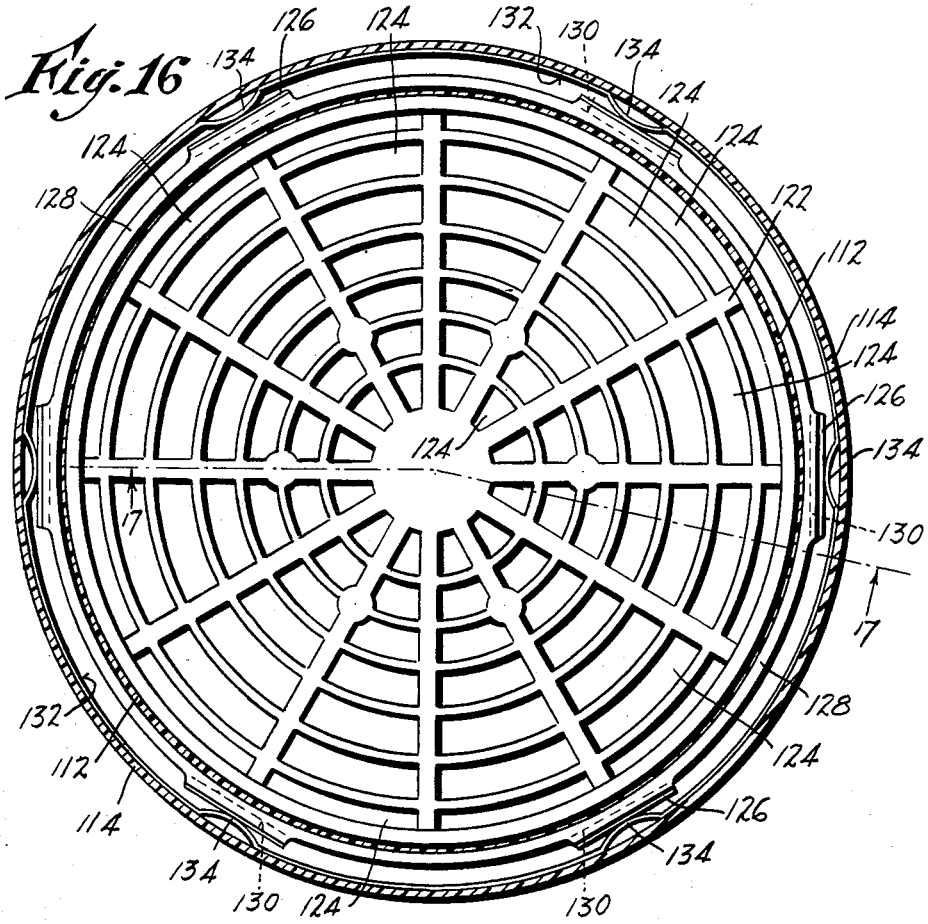
FIG. 16 is a horizontal section of a modified canister of a type employing a heated grid and a series of vertically disposed slab-like PTC heater members of the same general type as that of FIGS. 14 and 15, except that the heater members are disposed in planes which are generally parallel to the axis of the canister. The section is taken on the line 16—16 of FIG. 17.

FIG. 17 is a fragmentary axial section along a broken plane as indicated by the line 17—17 of FIG. 16, of the modified canister of FIG. 16, showing the method of making electrical connections to the slab-like heater members thereof. The section of FIG. 16 is taken on the line 16—16 of FIG. 17. An inner screen has been omitted to reveal interior details.

Figure 18:
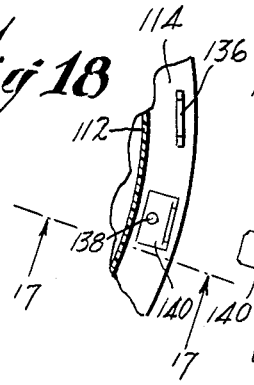

FIG. 18 is a fragmentary view, partly in top plan and partly in horizontal section, of the periphery of the modified canister of FIGS. 16 and 17, and particularly illustrating two terminals thereon, for establishing electrical connection from the vehicle's electrical system to the slab-like PTC heater members. The right peripheral portion of FIG. 17 is taken on the line 17—17 of FIG. 18. The spade terminal 140 has been omitted from FIG. 17, for clarity.

Figure 19:
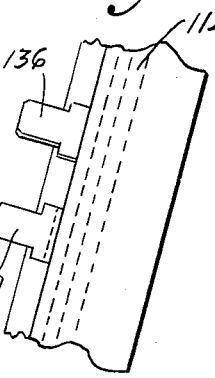

FIG. 19 is a side elevation of the periphery of the modified canister of FIGS. 16–18, showing the terminals of FIG. 18 in side elevation.

Figure 20:
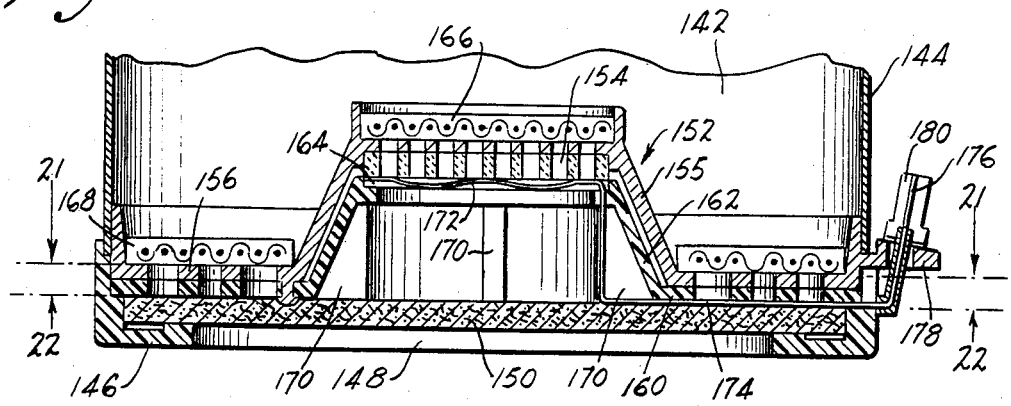

FIG. 20 is a fragmentary axial section of a further modified canister employing a heated grid, constituting a third embodiment of the invention.

Figure 21:
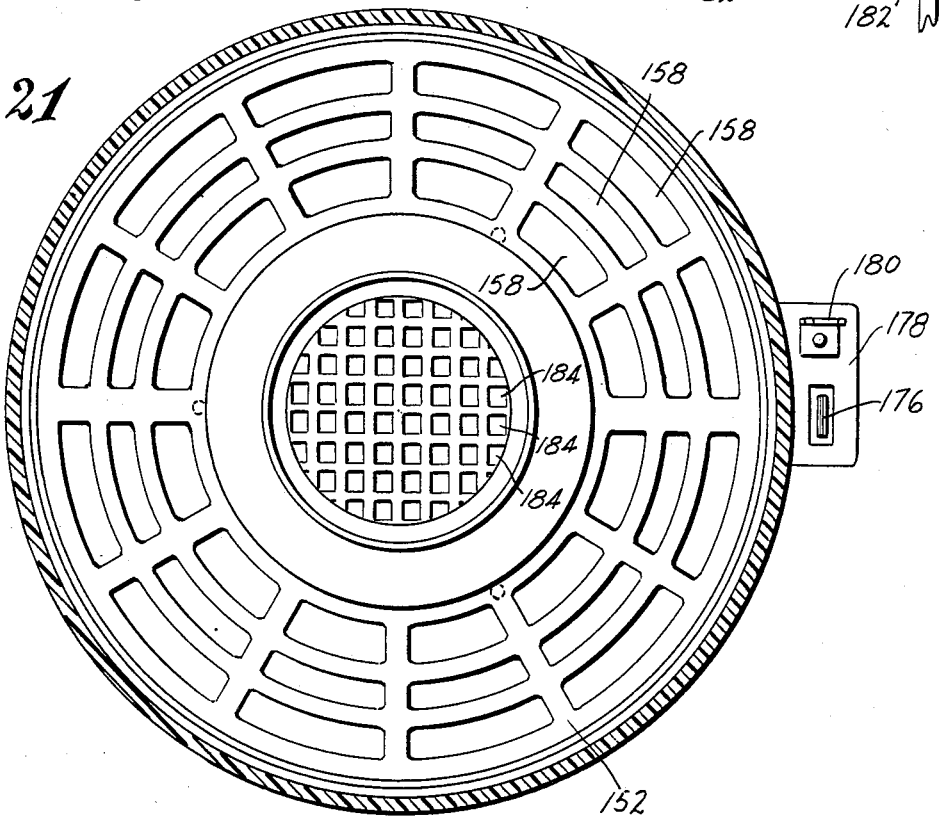

FIG. 21 is a horizontal section taken on the line 21—21 of FIG. 20.

Figure 22:
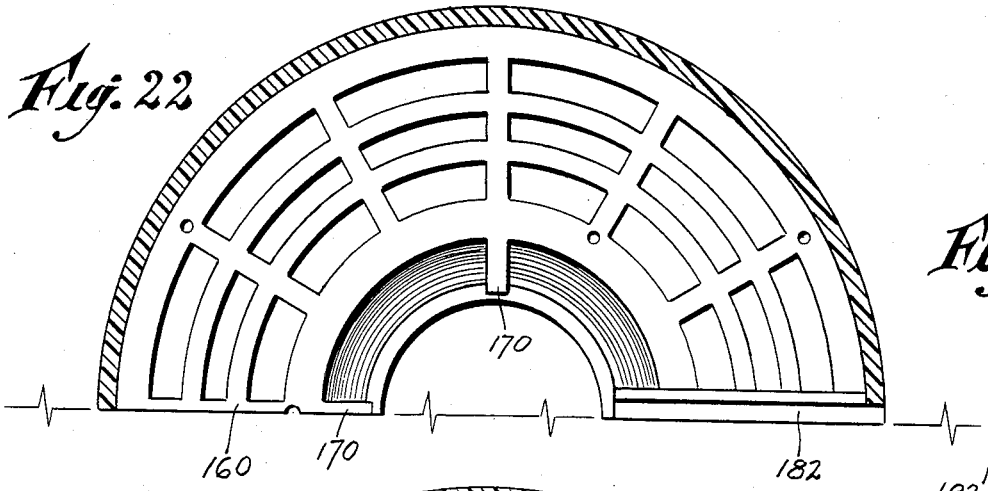

FIG. 22 is a fragmentary section taken on the line 22—22 of FIG. 20, showing a perforated spacer member that underlies a heated grid in the form of a conductive metal element.

Figure 23:
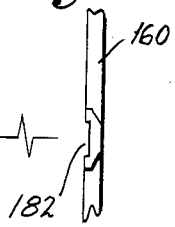

FIG. 23 is a fragmentary side elevation of the perforated spacer member of FIG. 22, particularly illustrating a groove therein which constitutes a clearance space for a conductive strip employed with the heater members carried by the canister of FIG. 20.

Figure 24:
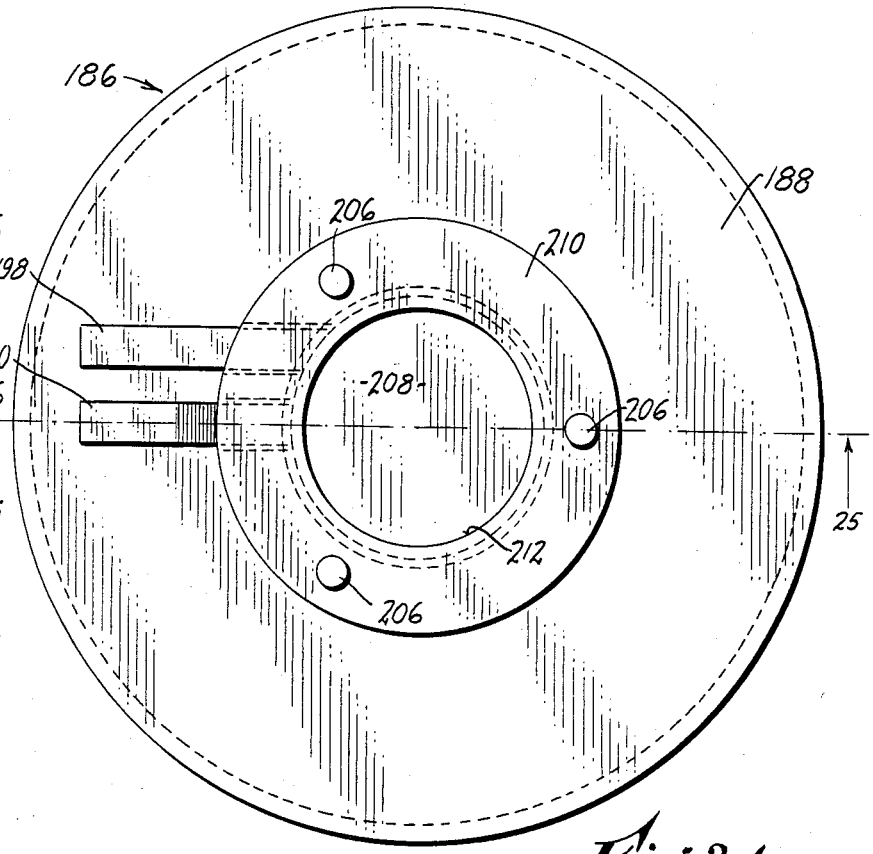

FIG. 24 is a bottom plan view of a closure plate or bottom cap for a canister having associated therewith a further modified PTC heater arrangement, this construction constituting yet another embodiment of the invention.

Figure 25:
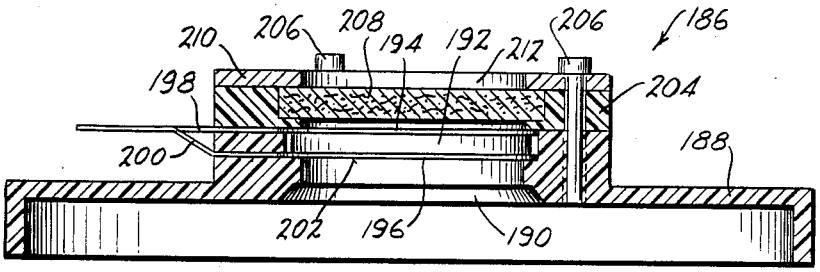

FIG. 25 is a section taken on the line 25—25 of FIG. 24.

Figure 27:
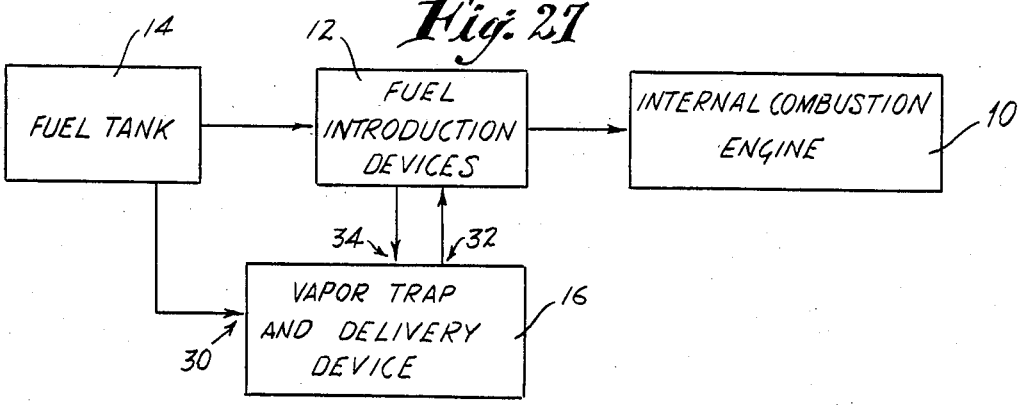
Figure 26:
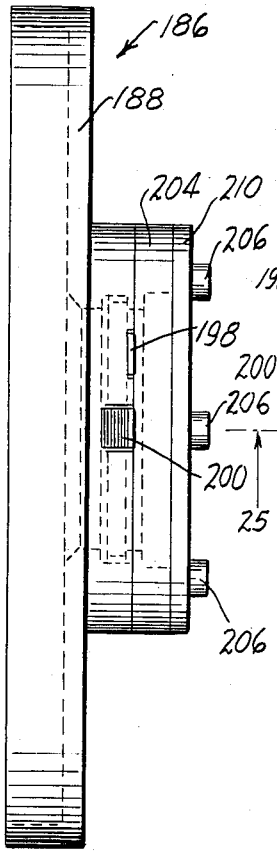

FIG. 26 is a left end elevation of the closure plate and heater construction of FIGS. 24 and 25, and FIG. 27 is a diagrammatic representation of the evaporative emission control system of the present invention, shown connected with the fuel tank of an automotive vehicle, the vehicle's engine, and with a fuel introduction device such as the engine's intake manifold or alternately the vehicle's carburetor.

Referring first to FIG. 27 there is illustrated diagrammatically an internal combustion engine 10 of conventional construction, having associated therewith fuel introduction or fuel intake devices 12 comprising the intake manifold of the engine and the carburetor, the latter having the usual float bowl (not shown), and a fuel storage system or gas tank 14. The fuel intake devices supply a combustible vapor mixture to the engine cylinders, in the usual manner.

In accordance with the present invention there is provided, in combination with the engine 10, tank 14, and devices 12, a novel and improved evaporative emission control system constituted as a fuel vapor trap and delivery device 16, which functions to effectively adsorb vapors that are emitted by the fuel tank and/or carburetor float bowl, storing such vapors and condensate and returning them to one of the fuel introduction devices associated with the engine, preferably the intake manifold thereof or alternately the carburetor, for delivery into the engine cylinders to be burned during the normal operation of the engine.

A preferred embodiment of the fuel vapor trap and delivery device 16 is drawn in axial section in FIG. 1, and further details thereof are shown in FIGS. 2–15. In FIG. 1, there is illustrated a canister constituting the device 16, having a cylindrical wall 18 preferably constituted of high-temperature plastic substance, the canister 16 having a top transverse wall 20 provided with multiple sets of openings 22, 24 and 26. Fitted over the top wall 20 is a plastic cap 28 that is preferably ultrasonically welded to the top wall 20 and side wall 18 of the canister 16. The cap 28 has a series of ports 30, 32 and 34. The ports are diagrammatically indicated in FIG. 27, and communicate with suitable nipples that accept rubber hoses. One port 30 is connected with a vapor line that extends to the fuel tank 14, functioning as a vent for vapors that would otherwise tend to collect in the tank. Such vapors are channelled through a hose to the port 30 in the event that pressure begins to build up in the tank, and are introduced into the canister interior through the openings 26. The cap 28 has a depending cylindrical skirt 36 extending part way down into the canister interior such that the incoming vapors are channelled to a location near the center of the canister. The latter is filled with a quantity of adsorbent granular material, typically activated carbon or charcoal, which functions to absorb and retain the fuel vapors in the form of condensate. The charcoal is designated 38 in FIG. 1. Immediately below the openings 22 and 24 is an annulus 40 of porous filter material that is suitably adhered to the top wall 20, in order to keep dust or other debris from entering the canister 16, and also to retain the charcoal and keep it from falling out through the ports 32, 34 during shipping or storage of the canister. A similar, circular piece of porous filter material 42 is disposed beneath the openings 26.

Figure 5:
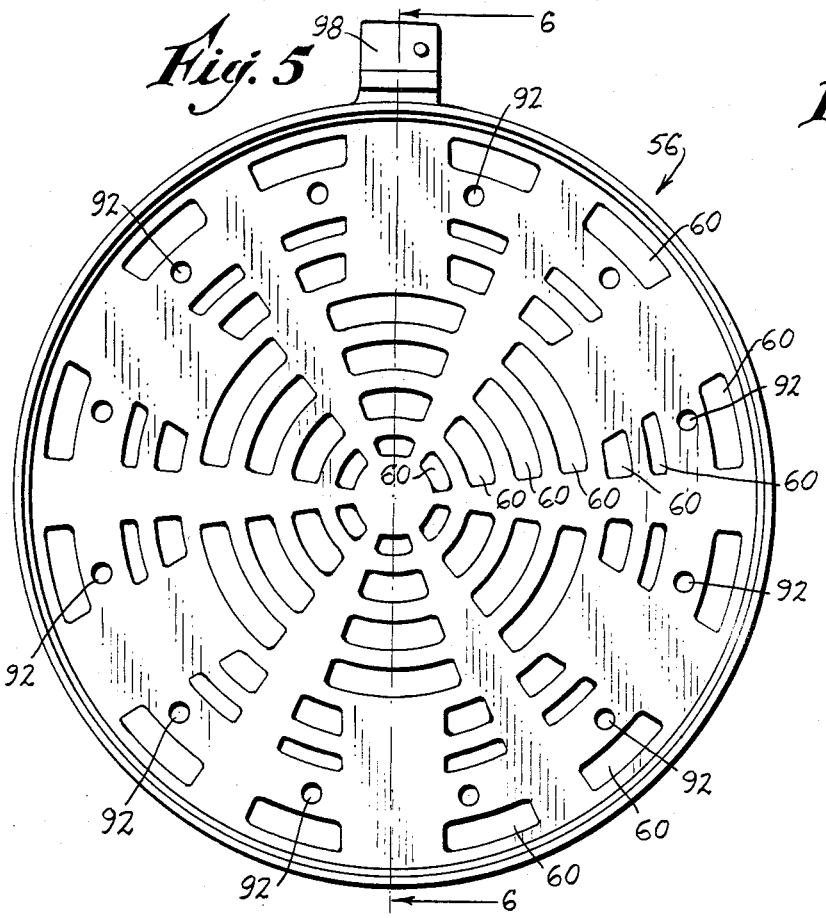
FIG. 5 is a top plan view of the second heat-conductive metal element in the form of a heated grid employed in the canister of FIG. 1.
Figure 6:
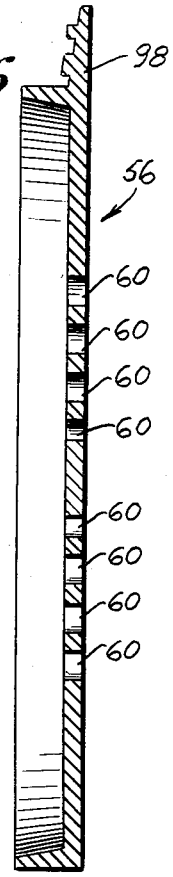
FIG. 6 is a section taken on the line 6—6 of FIG. 5.
Figure 7:
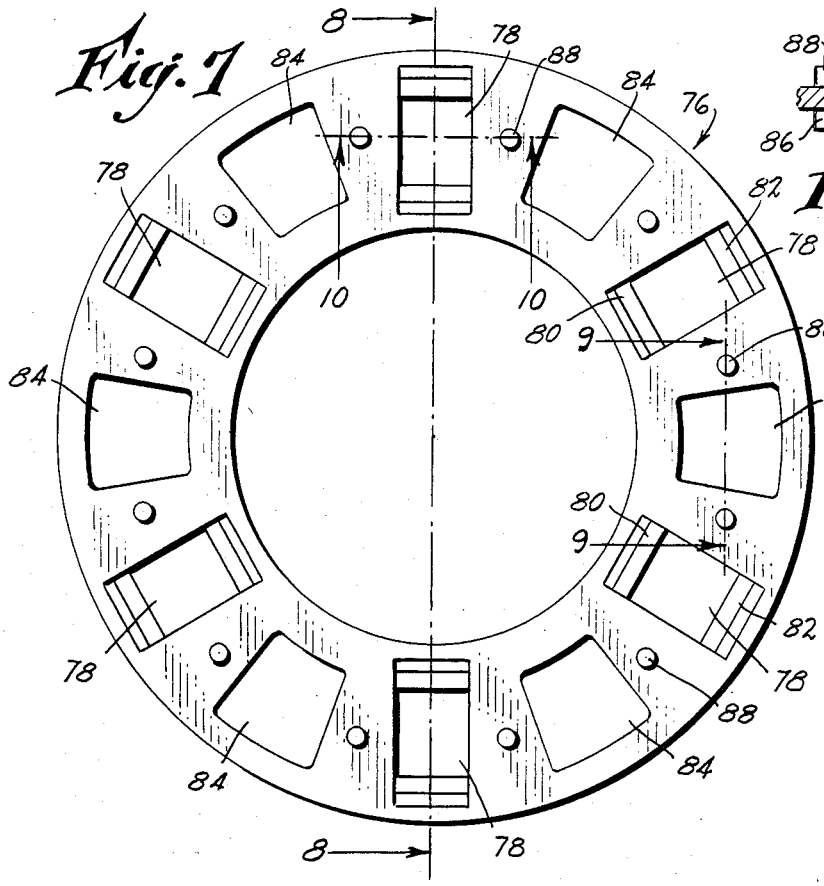
FIG. 7 is a top plan view of an insulating spacer member employed in the canister of FIG. 1, the spacer member being adapted to be sandwiched between the heat conductive metal elements shown in FIGS. 2 and 5, respectively.
Figure 10:
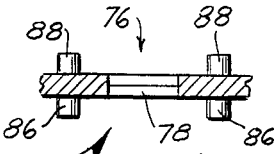
FIG. 10 is a fragmentary section taken on the line 10—10 of FIG. 7.
Figure 9:
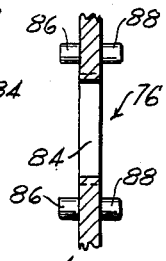
FIG. 9 is a fragmentary section taken on the line 9—9 of FIG. 7.
Figure 8:
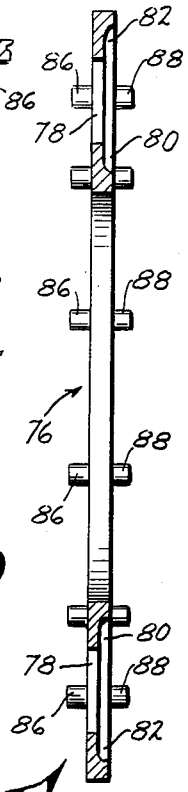
FIG. 8 is a section taken on the line 8—8 of FIG. 7.
Figure 14:
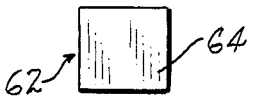
FIG. 14 is a top plan view of a slab-like member constituting a PTC (Positive Temperature Coefficient) heater device employed with the canister of FIG. 1.
Figure 15:
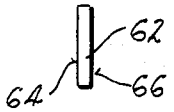
FIG. 15 is a side elevation of the slab-like heater member of FIG. 14.
Figure 13:
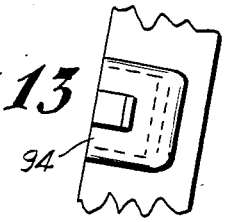
FIG. 13 is a fragmentary view of the retainer member of FIGS. 11 and 12, showing a hollow projection thereof which constitutes a protective housing for two electrical connector terminals employed with the canister of FIG. 1.
Figure 11:
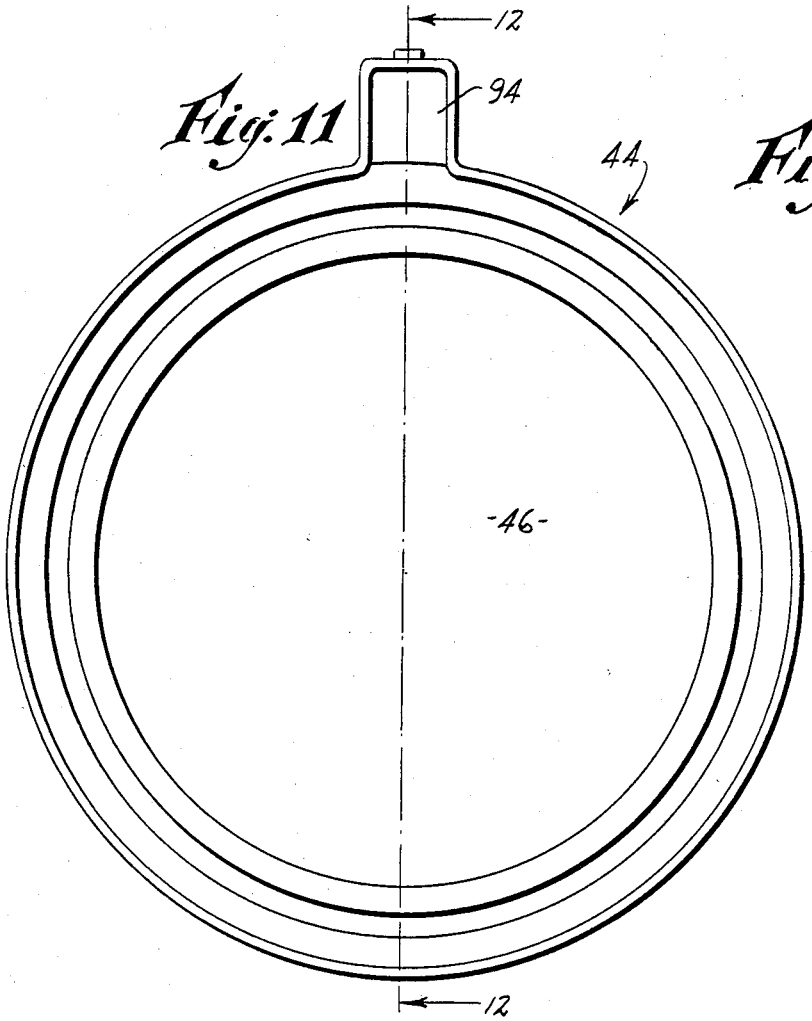
FIG. 11 is a top plan view of an annular plastic ring constituting a bottom retainer member for the canister of FIG. 1.
Figure 12:
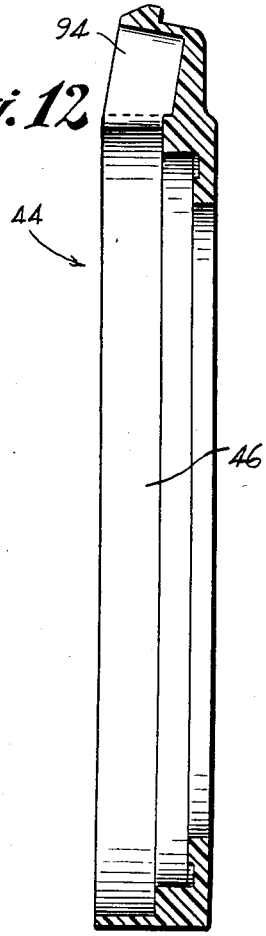
FIG. 12 is a section taken on the line 12—12 of FIG. 11.

The bottom of the canister side wall 18 is fitted with an annular cap 44 particularly shown in FIGS. 11–13. The wall 18 telescopes into the cap 44, as seen in FIG. 1, and is preferably secured in place by an ultrasonic weld or else by suitable high-temperature cement. The cap 44 has a large or expansive central opening 46 constituting a fresh air inlet to the canister. A disc 50 of filter material is held in position in the cap as shown, and a screen element 52 is located at the bottom of the canister, in order to retain the charcoal.

In accordance with the present invention and as illustrated in FIG. 1, there is provided in combination with the ported, charcoal-containing canister 16 as described above, a novel and improved, especially safe self-regulating heater system which can be selectively energized from the vehicle's electrical circuitry such that air drawn into the opening 46 in the cap 44 will be heated, and will thereafter transfer such heat to the charcoal 38 in order to enhance the release therefrom of fuel vapor and fuel condensate. The improved release of the stored fuel is particularly pronounced at low ambient temperatures. It has been found that when a vacuum is applied to the "purge" port 32 in an effort to draw in air through the opening 46 without the presence of heat, the release of stored fuel from the charcoal 38 occurs only very slowly at temperatures below 60 or 70 degrees Fahrenheit. By the present invention, however, the release of the trapped and stored fuel is greatly enhanced by a novel fast-acting and self-regulating safe heater system which is provided in the path of the fresh air flow and in good heat-exchanging relation with the charcoal 38. As a consequence, the release of fuel vapors or condensate from the charcoal is vastly improved, particularly when the engine is initially started. The effect of the rapid heating of air entering the opening 46 is to cause a significant increase in the rate at which stored fuel is purged from the canister. The fuel vapors are sucked into the line connected to the port 32, FIG. 27, after which they are drawn into either the carburetor or the intake manifold of the engine, under the action of the vacuum existing therein.

Preferably the heater system takes the form of a grid-like metal convector and radiator structure having large surface areas spanning the opening 46, such structure being constituted of heat conductive material and comprising one or more metal elements, two being shown in FIG. 1 and designated 54 and 56 respectively. Both the elements 54, 56 are apertured in order to enable air to pass freely through them. In the present embodiment, the apertures 58 and 60 are shown as being arcuate in shape, although their particular shapes and dispositions could deviate substantially from those indicated, without sacrifice in efficiency or operation.

The elements 54, 56 are disc-like, and can be advantageously constituted as zinc die-castings that exhibit both good thermal and good electrical conductivity. Moreover, the elements 54, 56 are relatively inexpensive to produce. By the present invention, there is provided a series of slab-like heater members or wafers 62 sandwiched between the elements 54, 56, the wafers 62 being particularly shown in FIGS. 14 and 15. They can be of simple rectangular outline, having oppositely disposed substantially parallel faces 64, 66 which are adapted to engage corresponding flat areas 68, 70 (FIG. 4) on the surfaces of the elements 54 and 56 respectively. FIG. 2 illustrates the locations of the wafers 62 in dotted outline.

Further, in accordance with the invention, the element 54 has a plurality of radial slits 72 that separate it into multiple pie-shaped sectors 74. The slits 72 enable the sectors 74 to slightly flex substantially independently of one another, so as to render them capable of undergoing limited twisting or bending. This capability for independent movement between the individual sectors 74 has been determined to constitute an important feature of the present invention since it has been found that the wafers 62 often have poor dimensional tolerances, and that the thicknesses thereof from unit to unit vary considerably. The ability of the sectors 74 to flex compensates for such variations, and as a result the engagement of the wafers 62 with the flat surfaces 68, 70 of the elements 54, 56 is improved. The integrity of the contact or engagement of the wafers 62 with the elements 54, 56 is important in order to insure good electrical contact between each slab and element, as well as good thermal conductivity therebetween.

Further in accordance with the invention, there is provided between the elements 54, 56 an insulating wafer-like spacer member 76 which is preferably constituted of plastic, the spacer member 76 being illustrated in FIGS. 7–10. As shown, the member 76 has clearance spaces or openings 78 circumferentially disposed about its periphery, which provide room for the wafers 62 when the elements 54, 56 are assembled as in FIGS. 1 and 4. Also, one face of the spacer member 76 is provided with relieved portions 80, 82 on the inner and outer edges of the openings 78, these relieved portions constituting clearance spaces for the wafers 62. The spacer member 76 also has additional openings 84, parts of which overlap the arcuate openings 58, 60 in the elements 54, 56 respectively, so as not to interfere with air flow through the latter.

The flat areas 68 of the element 54 can take the form of raised lands or plateaus, as shown in FIG. 3, which support the wafers 62; the provision of such raised lands would compensate for any differences in thickness between the wafers 62 and the spacer member 76, as in the present instance where the wafers are thinner than the spacer member.

The assemblage consisting of the wafers 62, metal elements 54, 56 and spacer member 76 can be fabricated as a sub-assembly, and when completed would appear as in FIG. 4. In accomplishing proper alignment between the parts, the spacer member 76 is provided on both of its opposite faces with a series of pilot projections 86, 88 that are adapted to be received in pilot holes 90, 92 (FIGS. 4 and 5), respectively of the metal elements 54, 56. The wafers 62 are sandwiched between the elements 54, 56 in the manner shown in FIGS. 1 and 4. With a moderate pressure applied to the sandwich, the pilot projections 86, 88 can be headed over by a suitable tool so as to retain the spacer member 76 firmly in position between the superposed metal elements. As noted above, the provision of the slits 72 in the element 54 enables limited flexing of the individual sectors 74 to occur, thus insuring that each of the wafers 62 is retained firmly in broadside engagement with the corresponding flat surfaces 68, 70 of the respective elements 54, 56.

Referring to FIGS. 11–13, the bottom retainer ring 44 of the canister 16 is provided with a hollow projecting portion 94 that is integral with the remainder of the ring. In FIG. 1, the metal elements 54 and 56 have radial lugs or radially extending projections 96, 98 respectively, with spade terminals or lugs 100, 102 staked in place. The projecting portion 94 of the bottom ring 44 has a recess that accepts the projections 96, 98 and lugs 100, 102. The latter two are adapted to be received in an electrical connector receptacle 104, shown in dotted outline, in order to bring power from the vehicle's electrical system to the elements 54, 56 for energization of the wafers 62. Electrical leads 106, 108 extend to suitable control circuitry (not shown) in the vehicle.

Further, in accordance with the invention, the wafers 62 are constituted of positive temperature coefficient material, preferably ceramic, which provides a self-regulating safety effect by automatically reducing the current drawn by the wafers as their temperature increases. Accordingly, when the wafers are first energized, they draw substantial current in order to achieve rapid heating, much of the heat in turn being transferred to the elements 54, 56. As the temperatures of both the wafers 62 and the elements 54, 56 increase, the resistance of the circuit through the wafers 62 increases considerably, thereby safely cutting down the current drawn, and reducing the heat produced. Eventually there is reached a point of safe equilibrium between the current drawn and the temperature established at the location of the wafers. This equilibrium point is not necessarily constant, but instead could vary with ambient temperature, engine compartment temperature, and the vacuum appearing at the port 32, for instance.

The operation of the improved evaporative emission control system of the present invention can now be readily understood by referring to FIGS. 1 and 27. Where it is desired that the system be employed solely with the fuel tank as opposed to both the tank and the carburetor float bowl, the port 34 of the canister 16 would be left open, or alternately closed off with a plug. With the vehicle idle, fumes in the fuel tank 14 which gradually build up in pressure are continuously vented into the port 30 and to the canister 16, entering the latter through the openings 26 and being adsorbed (absorbed and condensed) in the charcoal granules 38. There does not exist any back pressure in the canister because of the opening 46. With the engine off, no vacuum appears at port 32.

When the ignition is turned on, voltage is applied through lines 108, 106 to the elements 54, 56 which in turn energize the wafers 62. The wafers undergo rapid heating, transferring much of their heat to the elements. A vacuum at port 32 draws fresh air from the engine compartment of the vehicle through the opening 46, this air being heated as it passes through the elements, and in turn heating the charcoal granules 38. Initial heating of the grid occurs rapidly because of the fact that the resistance of the wafers 62 is low, and the current drawn is relatively high. As the wafer temperatures increase, the current is automatically reduced. Within a short interval, typically one or several minutes, much of the charcoal is brought up to a temperature that provides a satisfactory rate of release of the vapor and/or condensate that has accumulated therein during the time that the vehicle was idle. The temperature is maintained at an adequate level for as long as the ignition is on. During engine operation, venting of the fuel tank into the canister can still occur; vapors arriving therein will be continuously drawn off by the vacuum appearing at port 32.

If it is desired that the evaporative emission control system of the present invention be employed to collect vapors from both the fuel tank and the carburetor float bowl, the other port 34 on the canister 16 would be connected to the float bowl through a suitable line, FIG. 27. Under such circumstances, a valve (not shown) in the line would isolate the carburetor from the canister during engine operation. In other respects the functioning would be the same as that described above. That is, during periods when the vehicle is idle, vapors from both the fuel tank and the carburetor float bowl would be vented into the canister and adsorbed. When the ignition was turned on and the engine started, vacuum at port 32 would cause fresh air to be drawn in through the opening 46 to be heated by the grid; the heat would thereafter be transferred to the charcoal and facilitate its release of the stored fuel.

Another embodiment of the invention is shown in FIGS. 16–19. FIG. 17 illustrates the lower portion of a charcoal-containing canister designated 110 having a cylindrical side wall 112 and an enlarged-diameter flange 114 that is integral with the wall 112. The bottom of the canister is fitted with an annular retainer ring 116 that is ultrasonically welded in position, or alternately secured with suitable cement or adhesive. The ring 116 supports a porous disc-like filter 118, and a screen 120 is disposed at the bottom of the canister in order to support charcoal granules contained therein.

By the present invention there is provided a novel and improved safety heater assembly for use with the canister 110, for enhancing the release of fuel vapors and fumes that have been adsorbed in the charcoal. In accomplishing the heating, there is disposed at the bottom of the canister 110 a heat and electrically conductive metal grid 122 having multiple arcuate apertures 124 that permit fresh air to be drawn therethrough and into the canister when a vacuum is applied to one of the ports (not shown) at the canister top. The screen 120 preferably is seated in a circular recess in the top of the grid, as shown, and the grid has an annular upstanding flange which is fitted inside the annular wall 112 of the canister.

As provided herein there is disposed about the periphery of the grid 122 a series of heater wafers 126 similar to the wafer 62 in the previous embodiment. Preferably a total of six such wafers is employed, spaced circumferentially from one another by 60 degrees, as in FIG. 16. The grid has an annular peripheral flange 128 containing flattened areas 130 against which the wafers 126 are positioned. The wafers are in good electrical and thermal contact with the flange 128. In addition, disposed adjacent the inner surface of the flange 114 of the canister is a conductive, resilient mounting ring 132 having inwardly extending bowed portions 134 that press against and retain the wafers 126 in place. The ring 132 constitutes a force-applying means for the wafers 126, to establish pressure contact therewith. The ring is electrically conductive and has an upstanding portion, FIG. 17, that terminates in a spade lug 136, suitable for direct connection to an electrical connector receptacle (not shown). The flange 128 of the grid has a small upstanding projection 138, FIGS. 17 and 18, and a spade lug 140 carried thereon. The lug can be secured by staking it in position, as shown. The lug is omitted from FIG. 17, for clarity.

By the above arrangement, there is established a good thermal contact between the wafers 126 and the grid 122. In addition, application of a suitable voltage to the spade lugs 136, 140 from a connector receptacle (not shown) extending to the vehicle's electrical system will in turn energize the wafers 126 through the ring 132.

In accordance with the invention the wafers 126 are constituted of positive temperature coefficient material, preferably ceramic, as in the previous embodiment. Initial energization of the material results in an inrush of current, whereby rapid heating takes place. As the temperature rises, the current is automatically reduced to a considerably lower, safe equilibrium point wherein the heat being dissipated by the wafers is balanced by the power being supplied thereto. The good thermal contact between the wafers and the grid 122 results in fast heating of the latter, such that once the ignition of the vehicle is turned on and the engine started, vacuum at that port of the canister 110 corresponding to the port 32 of the construction of FIG. 1 will result in fresh air being drawn in through the bottom of the canister, heated by the grid, and transferred to the charcoal granules. This in turn will raise the temperature of the granules to a point which greatly enhances the release of the fuel vapor/condensate that has been accumulated or stored.

Yet another embodiment of the invention is illustrated in FIGS. 20–23. FIG. 20 shows the bottom portion of a further modified canister 142 having a generally cylindrical side wall 144 and a bottom retainer ring 146 secured thereto. The ring 146 has a central opening 148 by which fresh air can enter the interior of the canister, as in the previous arrangements. A circular porous filter 150 is held in position by the ring 146.

By the invention, there is disposed within the canister 142 a conductive metal grid 152 in good thermal and electrical contact with a heater slab in the form of an apertured positive temperature coefficient ceramic wafer 154. The grid is preferably a casting having a conical central portion 155, and a flat peripheral portion 156, the latter having multiple arcuate apertures 158 to enable fresh air to pass freely therethrough. A spacer member 160 preferably constituted of high temperature plastic underlies the grid, and has a conical portion 162 with an opening 164 that provides a seat for the ceramic wafer 154. The latter is thus sandwiched between the spacer member 160 and the grid 152. Two screens are provided, designated 166 and 168, the latter being annular, and both preventing charcoal granules carried in the interior of the canister from passing through the apertures of the grid.

By the present invention the spacer member 160 constitutes a rigid support for the ceramic wafer 154, and locates the wafer at a point which is substantially completely within the confines of the canister cylinder, displaced inwardly of a plane defined by the peripheral bottom edge of the canister side wall 144. Maximum use of the heat from the wafer 154 is thus had. On the underside of the spacer member 160 are radially extending ribs 170. In addition, disposed between the walls of the opening 164 and the wafer 154 is a resilient, spring wave washer 172 having a radially extending portion 174 which is connected to a spade lug 176 that is insulatedly carried on a support portion 178 of the grid 152. In addition, the support portion 178 carries a second spade lug 180. The lugs 176 and 180 are adapted for connection to the electrical system of the vehicle. The radially extending portion 174 is seated in a groove 182 in the underside of the spacer member, the groove being shown in FIGS. 22 and 23. In the present instance, the wafer 154 has multiple transverse openings 184 which permit air to flow directly through the wafer and into the canister interior. Electrical connection to the wafer 154 is effected by the grid 152 making contact with the upper surface of the wafer, and the wave washer 172 establishing contact with the lower surface thereof.

In operation, during the application of a voltage to the lugs 176 and 180, and a vacuum to the appropriate port of the canister, air is drawn in through the filter 150, and passes either through the openings in the spacer member 160 and grid 152, or directly through the openings 184 in the ceramic wafer 154 and thereafter through the screen 166. As presently understood, the disposition of the positive temperature coefficient ceramic wafer 154 within the canister provides improved heating of the charcoal granules, since the heat source is surrounded and physically closer thereto than in the prior arrangements. Since the path between the ceramic wafer and the vacuum port has been shortened as compared with that of the earlier disclosed arrangements, the response time required for the heat to permeate the granules is reduced, and less heat is lost due to radiation to the outside than would be the case where the heat sources were less centrally located. Also, there is less likelihood of heat loss through the bottom of the canister.

A further modification of the invention is illustrated in FIGS. 24–26, showing a greatly simplified arrangement for a bottom plate of a canister of the type shown in FIG. 1. In the present arrangement, the structure of FIG. 25 would be applied to the bottom of a cylindrical canister, with the addition of perhaps a filter screen (not shown) in order to support and retain the particles or granules of charcoal.

This simplified construction is generally designated by the numeral 186, and comprises a cup-like bottom plate 188 which is adapted to telescope over the cylindrical side wall of a charcoal-filled canister similar to those of the first embodiment. The plate 188 has a central opening 190 which is spanned by a wafer of positive temperature coefficient material, preferably ceramic, designated 192. Two circular contacts 194, 196 are provided on opposite faces of the wafer 192, and each has a radial contact strip or tail 198, 200 respectively. The lower contact 196 in FIG. 25 is supported on an annular ledge 202 which is molded integral with the remainder of the plate 188. The upper contact 194 is held in position by a retainer disc 204 secured by three cap screws 206. The latter are received in threaded holes in the plate 188. Disposed above the heater element 192 is a circular sheet of porous filter material 208, such as fiberglass wadding, this being held in position by a second retainer disc 210 that is secured by the same cap screws 206 which hold the disc 204. The disc 210 has a central aperture 212 which permits fresh air to be drawn into the canister, downwardly in FIG. 25, and to flow through multiple holes in the wafer 192 to receive heat therefrom. The heat is then transferred to the charcoal contained in the canister, resulting in an enhancement of the release of the vapor/condensate that is stored therein. Aside from this central opening, the remainder of the plate 188 is substantially imperforate.

Connection to the contacts 198, 200 can be made by a suitable electrical connector receptacle (not shown), which supplies power to the wafer 192 from the electrical system of the vehicle when the ignition circuit is energized. In other respects the operation of the arrangement shown in FIGS. 24–26 is similar to that of the first three embodiments that have been disclosed, and accordingly further details thereof are not given.

It is to be understood that by the present invention, existing canister constructions of a passive, unheated type could be fitted with a heater cap arrangement similar to that of FIGS. 24–26, for example, wherein there would be realized the advantages noted above in connection with improved purging of the canister under the action of heated air that is drawn into its interior. Under such circumstances, little or no modification of the "passive" canister would be required, other than securing the heater assembly in position over the air intake port of the canister.

From the above it can be seen that we have provided novel and improved evaporative emission control systems which are both especially safe in operation and simple in structure, and which provide considerably increased efficiency over those previously known, especially under cold conditions. In prior systems, after the vehicle has been idle for a prolonged period and under conditions of freezing temperatures, the carbon or charcoal granules normally contained in the purification canister do not respond sufficiently fast in establishing the "purge" function; that is, the release of stored vapor/condensate does not occur to a significant extent until the temperature of the area where the canister is mounted reaches a higher value. Frequently this time lag could amount to many minutes. In the meantime, the desired objective of drawing off the stored fuel and disposing of it in the intake manifold is delayed. The problem has been almost completely overcome by the arrangements of the present invention, since upon energization of the ignition circuit the heater devices that are associated with the canister are activated immediately and are self-regulating; and fresh air from the exterior of the canister is drawn therein, passing through either a grid that is heated by the devices, or by passing through multiple holes contained in the heater material itself. A simple yet effective solution thereby is had, without the need for complex control circuits involving temperature sensors and feedback arrangements normally associated with electric heaters.

The devices thus disclosed are seen to represent a distinct advance and improvement in the field of pollution control systems for automotive vehicles.

Each and every one of the appended claims defines an aspect of the invention which is separate and distinct from all others, and accordingly it is intended that each claim be treated in this manner when examined in the light of the prior art devices in any determination of novelty or validity.

Variations and modifications are possible without departing from the spirit of the invention.

What is claimed is:

1. In an internal combustion engine, in combination:

(a) a fuel system comprising a fuel intake device for supplying a combustible vapor mixture to the engine, (b) a canister and means connecting the same to said fuel system of the engine to receive vapors therefrom, (c) an adsorptive material in the canister for adsorbing vapors that are brought therein, (d) heating means carried by the canister, for heating said adsorptive material to enhance the release of said vapors, (e) means connecting said canister to the fuel intake device to deliver thereto vapors recovered from said adsorptive material, and (f) a grid in said canister, said grid comprising large surface areas and being constituted of good heat conductive material disposed in heat transferring relation with said heating means and with said adsorptive material.

2. The invention as set forth in claim 1, wherein:

(a) said heating means comprises a positive temperature coefficient member, (b) said member having a slab-like configuration with one substantially flat face, (c) said grid having a corresponding flat surface area against which said flat face of said member is disposed.

3. The invention as set forth in claim 1, wherein:

(a) said grid comprises two superposed metal elements, (b) said heating means comprises a slab-like member having oppositely disposed substantially flat faces, (c) said slab-like member being sandwiched between said superposed metal elements, and being in good heat-exchanging relation with both elements.

4. The invention as set forth in claim 3, and further including:

(a) electrical conductor means disposed at the exterior of the canister, and means making independent electrical connections from each of the elements to said electrical conductor means, such that the slab-like member can be energized by current flowing through the elements.

5. The invention as set forth in claim 1, wherein:

(a) said heating means comprises a slab-like member, (b) said member having one substantially flat face which is in electrical contact with said grid, and (c) electrical conductor means disposed at the exterior of the canister, and means making electrical connection from the grid to said electrical conductor means, such that the slab-like member can be energized by current flowing through the grid.

6. In an internal combustion engine, in combination:

(a) a fuel system comprising a fuel intake device for supplying a combustible vapor mixture to the engine, (b) a canister and means connecting the same to said fuel system of the engine to receive vapors therefrom, (c) an adsorption material in the canister for adsorbing vapors that are brought therein, (d) means for heating said adsorptive material to enhance the release of said vapors, (e) means connecting said canister to the fuel intake device to deliver thereto vapors recovered from said adsorptive material, (f) said heating means comprising a positive temperature coefficient member carried by said canister and disposed in heat transferring relation with said adsorptive material, and (g) electrical conductor means disposed at the exterior of the canister, and means for making electrical connections from the positive temperature coefficient member to said electrical conductor means, so as to enable the member to be selectively energized through said conductor means.

7. The invention as set forth in claim 1, wherein:

(a) the canister has an expansive air intake opening, and (b) said grid spans at least a portion of said opening such that some of the air flowing into the said intake opening flows through said grid and is heated thereby.

8. The invention as set forth in claim 7, wherein:

(a) said intake opening is disposed at the bottom of the canister.

9. The invention as set forth in claim 1, wherein:

(a) said grid comprises two superposed metal elements, (b) said heating means comprising a multiplicity of slab-like members each of which has oppositely disposed substantially flat faces, (c) said slab-like members being spaced from one another, and each member having one of its faces engageable with one of said metal elements and having its other face engaged with the other of said elements, (d) said members being in good thermal contact with both of said elements.

10. The invention as set forth in claim 9, and further including:

(a) electrical means connected with said elements, for bringing supply voltage to said slab-like members for effecting energization thereof.

11. The invention as set forth in claim 10, wherein:

(a) said electrical means is capable of maintaining said elements at a distinct electrical potential with respect to one another.

12. The invention as set forth in claim 11, wherein:

(a) said members comprise slabs of material having positive temperature coefficients.

13. The invention as set forth in claim 1, wherein:

(a) said grid comprises two superposed metal elements, (b) said heating means comprising a multiplicity of slab-like members each of which has oppositely disposed substantially flat faces, (c) one of said elements having multiple radial slits, separating said one element into multiple sectors, (d) said sectors being resilient and capable of limited flexing essentially independently of one another so as to accommodate slight variances in the dimensional tolerances of the said slab-like members and thereby insure engagement of the surfaces of the sectors with the faces of the slab-like members, respectively.

14. The invention as set forth in claim 9, and further including:

(a) an insulating spacer member disposed between the said elements, (b) said spacer member having apertures to provide clearance for said slab-like members, thereby permitting said elements to firmly engage opposite faces of the said members.

15. The invention as set forth in claim 9, wherein:

(a) one of said elements has a series of raised lands, constituting plateaus on which said slab-like members are seated, respectively, (b) an insulating spacer member disposed between said elements, (c) said spacer member having apertures to provide clearance for said slab-like members, and for said raised lands.

16. The invention as set forth in claim 9, wherein:

(a) said superposed metal elements each have a radially extending projection, said projections extending radially beyond the side wall of the canister, and (b) electrical spade terminals mounted on said projections, respectively, so as to permit installation of a suitable electrical connector thereon for bringing electrical power to the said metal elements and slab-like members.

17. The invention as set forth in claim 9, wherein:

(a) each of said elements has a series of pilot holes adapted to align with one another, (b) an insulating, wafer-like spacer member having pilot projections extending on opposite sides thereof, (c) said pilot projections being adapted to be received in said pilot holes, respectively, for establishing alignment between the elements and spacer member.

18. The invention as set forth in claim 17, wherein:

(a) said spacer member is constituted of plastic, (b) the ends of said pilot projections being headed over the respective pilot holes, following assembly, in order to retain the metal elements and spacer member in overlying relation.

19. The invention as set forth in claim 1, wherein:

(a) the canister has an expansive air intake opening, (b) said grid spanning at least a portion of said opening such that some of the air flowing into the said intake opening flows through said grid and is heated thereby, (c) said grid comprising two superposed metal elements, (d) said heating means comprising a multiplicity of slab-like members each of which has oppositely disposed substantially flat faces, (e) said slab-like members being spaced from one another, and each member having one of its faces engageable with one of said metal elements, and having its other face engaged with the other of said elements, (f) said members being in good thermal contact with both of said elements.

20. The invention as set forth in claim 9, wherein:

(a) said metal elements are apertured in order to permit air to flow therethrough.

21. The invention as set forth in claim 3, wherein:

(a) said metal elements are apertured in order to permit air to flow therethrough.

22. The invention as set forth in claim 3, and further including:

(a) an insulating, wafer-like spacer member sandwiched between said metal elements, (b) said elements and spacer member constituting an assembly, and said assembly having at least some aligned apertures, to permit air to flow through the said assembly.

23. An electric heater construction for a charcoal-containing canister of the type employed in an evaporative emission control system for an internal combustion engine, the canister having a generally cylindrical side wall and an apertured bottom wall, and the heater construction comprising in combination:

(a) an electrically conductive metal element extending at least partially across the bottom wall of the canister, said element having multiple apertures to permit flow of air therethrough and into the interior of the canister, (b) a positive temperature coefficient ceramic member disposed in close heat-exchanging relation to said metal element so as to be capable of transferring heat thereto, said ceramic member having a portion in electrical contact therewith, (c) means providing an electrical contact to another portion of said positive temperature coefficient ceramic member, and (d) electrical conductor means disposed at the exterior of the canister, and means providing electrical connections from the electrically conductive metal element and from the said electrical contact to said electrical conductor means, so as to enable the positive temperature coefficient ceramic member to be selectively energized through said conductor means, whereby air entering the apertured bottom wall of the canister passes through the said multiple apertures of the metal element to be heated thereby.

24. The invention as set forth in claim 1, wherein:

(a) said grid has an annular peripheral flange, (b) a plurality of positive temperature coefficient members located adjacent said flange and in good thermal contact therewith, and (c) electrical means connected with said members for selectively energizing the same.

25. The invention as set forth in claim 24, wherein:

(a) said members have first portions in direct physical contact with said flange, and (b) force applying means engageable with other portions of said members, for establishing pressure contact between said first portions and said flange.

26. The invention as set forth in claim 25, wherein:

(a) said electrical means is connected with said force applying means.

27. The invention as set forth in claim 24, wherein:

(a) said canister has an axis, and (b) said members having a substantially flat configuration, with opposite faces that are generally parallel to the axis of the canister.

28. The invention as set forth in claim 24, wherein:

(a) said electrical means comprises a spade terminal carried by said flange.

29. The invention as set forth in claim 26, wherein:

(a) said electrical means comprises a spade terminal carried by said force applying means.

30. The invention as set forth in claim 24, wherein:

(a) said grid comprises an apertured, one-piece metal element all portions of which are integral with one another.

31. The invention as set forth in claim 30, wherein:

(a) said members each have one flat face, (b) said flange has flat surface areas against which the flat faces of said members directly bear, respectively.

32. The invention as set forth in claim 24, wherein:

(a) said members are circumferentially spaced from one another about the flange.

33. The invention as set forth in claim 1, wherein:

(a) said grid extends at least partially across the bottom of the canister, (b) said heating means being carried directly by said grid and comprising a heater member constituted of positive temperature coefficient material, (c) said heater member having a multiplicity of apertures through which air drawn into the canister can flow and be heated.

34. The invention as set forth in claim 33, and further including:

(a) electrical conductor means disposed at the exterior of the canister, and electrical spring contact means engaging the heater member, and electrically connected with said electrical conductor means, to enable the member to be selectively energized through said conductor means.

35. The invention as set forth in claim 33, wherein:

(a) said canister has a cylindrical wall with a bottom opening surrounded by a peripheral edge, (b) said heater member being displaced inwardly from the plane defined by said peripheral edge, so as to lie substantially completely within the confines of the canister cylinder and thereby minimize heat loss through the bottom opening thereof.

36. The invention as set forth in claim 6, wherein:

(a) said canister has a bottom wall with a central opening.

(b) said member being disposed in said opening, and having multiple passages to permit entering the opening to flow therethrough.

37. The invention as set forth in claim 36, wherein:

(a) remaining portions of the bottom wall are imperforate.

38. As a retro-fit, an electric heater construction for a charcoal-containing canister of the type employed in an evaporator emission control system for the fuel system of an internal combustion engine, the canister having a generally cylindrical side wall, and the heater construction comprising in combination:

(a) support means adapted to be connected to said canister and extending at least partially across the bottom thereof, (b) means for securing said support means to said canister, (c) a positive temperature coefficient ceramic member carried by said support means and disposed in a position so as to be capable of transferring heat to air being drawn into the canister interior through its bottom, and (d) electrical conductor means disposed at the exterior of the canister, and electrical contact means on said support means and connected with said electrical conductor means, and with said positive temperature coefficient ceramic member, to enable selective energization thereof, whereby heat imparted to air flowing past the ceramic member into the canister interior can be transferred to said charcoal, thereby improving the purging of fuel stored therein, (e) said positive temperature conefficient ceramic member being self-regulating so as to permit rapid heating to occur initially, but without danger of subsequent overheating and possible ignition of the fuel being purged.

* * * * *